United States Patent [19]

Kent et al.

[11] Patent Number: 5,063,725

[45] Date of Patent: Nov. 12, 1991

[54] METHOD AND APPARATUS FOR APPLYING RECTANGULAR CLOSURES TO RECTANGULAR CONTAINERS

[75] Inventors: James V. Kent, Alden; Theodore E. Westbrook, Sr., Amherst, both of N.Y.

[73] Assignee: Figgie International, Inc., Willoughby, Ohio

[21] Appl. No.: 661,544

[22] Filed: Feb. 26, 1991

[51] Int. Cl.[5] ..... B65B 7/28; B67B 3/20; B67B 3/28; B67B 5/00

[52] U.S. Cl. ..... 53/485; 53/490; 53/306; 53/317; 53/331.5; 53/367

[58] Field of Search ..... 53/485, 490, 306, 308, 53/317, 329, 331.5, 367

[56] References Cited

U.S. PATENT DOCUMENTS

| | | | |
|---|---|---|---|
| 2,819,577 | 1/1958 | Dimond . | |
| 3,054,240 | 9/1962 | Dimond . | |
| 3,537,231 | 11/1970 | Dimond | 53/317 X |
| 3,852,941 | 12/1974 | Bross | 53/331.5 X |
| 3,882,660 | 5/1975 | Sterling | 53/367 X |
| 3,961,463 | 6/1976 | Dimond et al. . | |
| 4,089,153 | 5/1978 | Long . | |
| 4,156,490 | 5/1979 | Peraboni | 53/490 X |
| 4,267,683 | 5/1981 | Harrington | 53/331.5 |
| 4,653,676 | 3/1987 | Stull | 53/367 X |

*Primary Examiner*—Horace M. Culver
*Attorney, Agent, or Firm*—Hodgson, Russ, Andrews, Woods & Goodyear

[57] ABSTRACT

A method and apparatus for applying closures to containers, and capable of applying stake-on caps having generally rectangular cross-sectional exterior surfaces to container whose bodies are also of the same general cross-section, the parts being delivered in random orientation, and each cap being applied to a container in such a manner that it is in proper orientation with respect to the container when finally assembled. The apparatus includes a turret (54) provided with a non-rotatable cam (108), an interrupted drive gear (114), and an alternate continuous drive gear (124). Mounted on the turret (54) for rotation about the centerline of the turret are a plurality of spindle assemblies (90). When applying a rectangular closure (14) to a container (12) designed to receive the closure in only one position of orientation a novel chuck assembly (130) is employed which has an engagement portion which may be held in one of two detent positions spaced 180° apart. When this form of chuck assembly is utilized a driven gear (112) is coupled to the interrupted drive gear (114) by a clutch assembly including a hub (116) mounted on spline shaft (94) and key (118). The parts are so designed that the closure engaging portion (138, 140) will be rotated either 180° or 360° as the body (132) of the chuck assembly is caused to be rotated 360°. When a conventional closure is to be applied to a conventional container, a conventional chuck assembly is substituted for the chuck assembly (130) of this invention and the rotatable spindle is caused to be continuously rotated by a continuous gear (124).

10 Claims, 8 Drawing Sheets

Fig. 1.
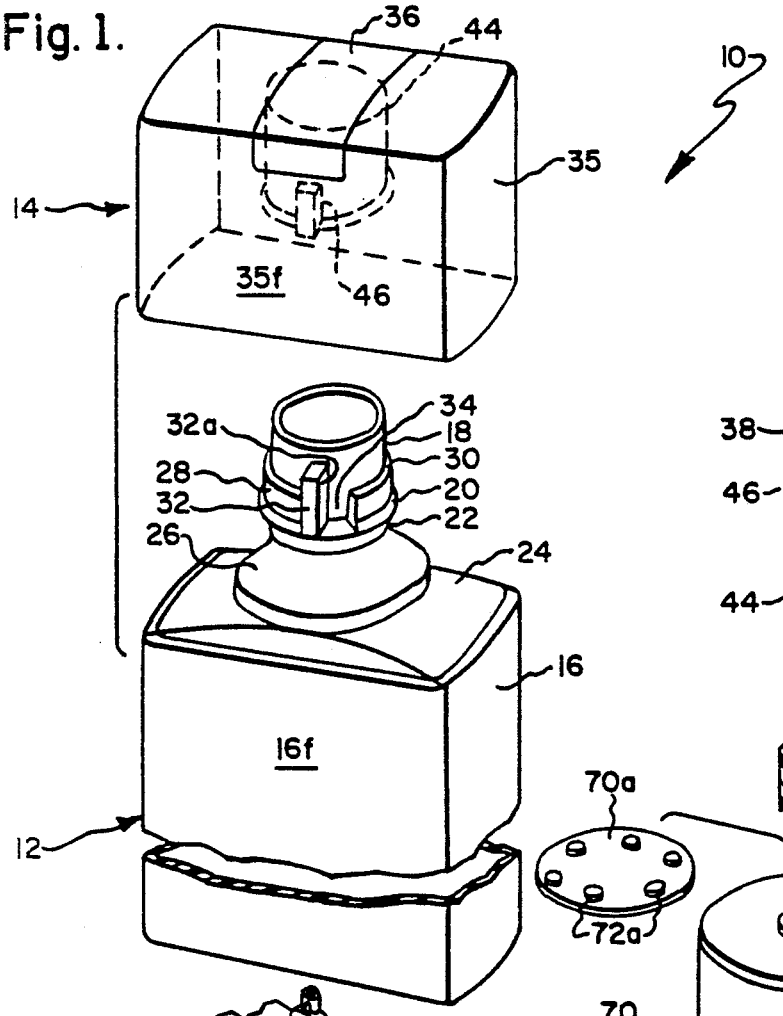
Fig. 1a.
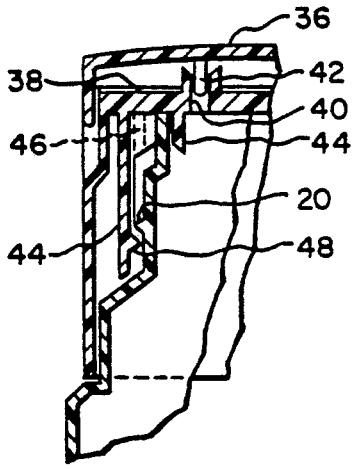
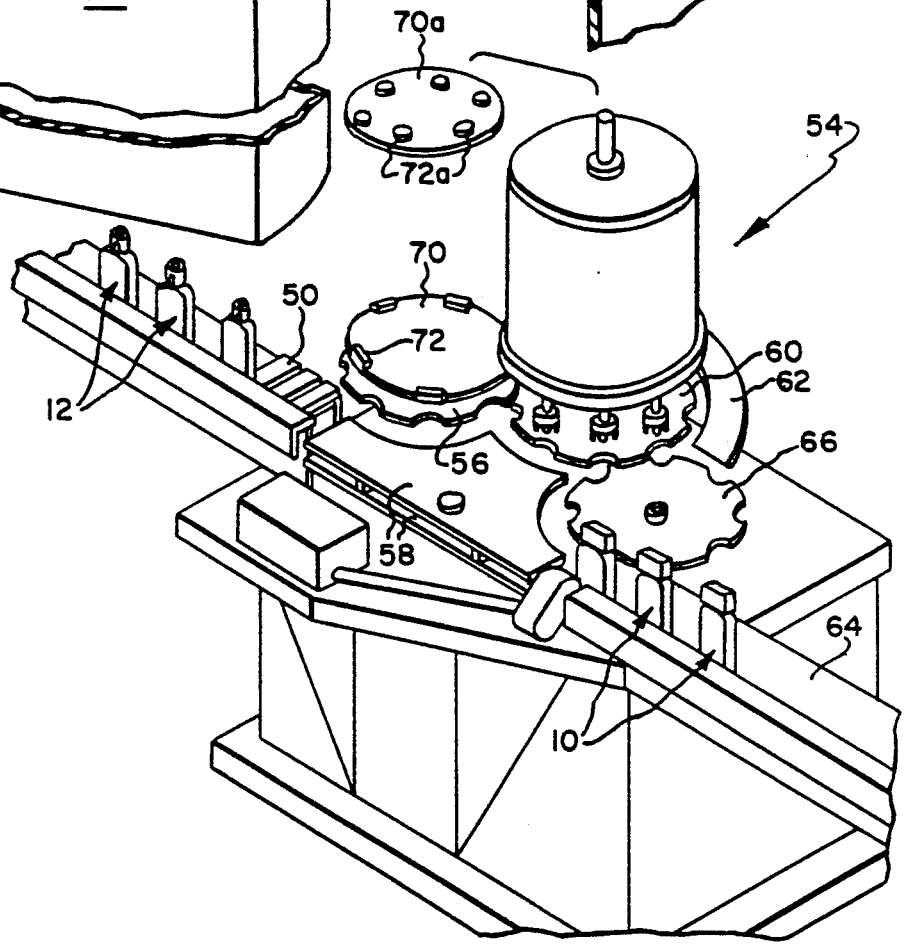
Fig. 2.

Fig. 7.
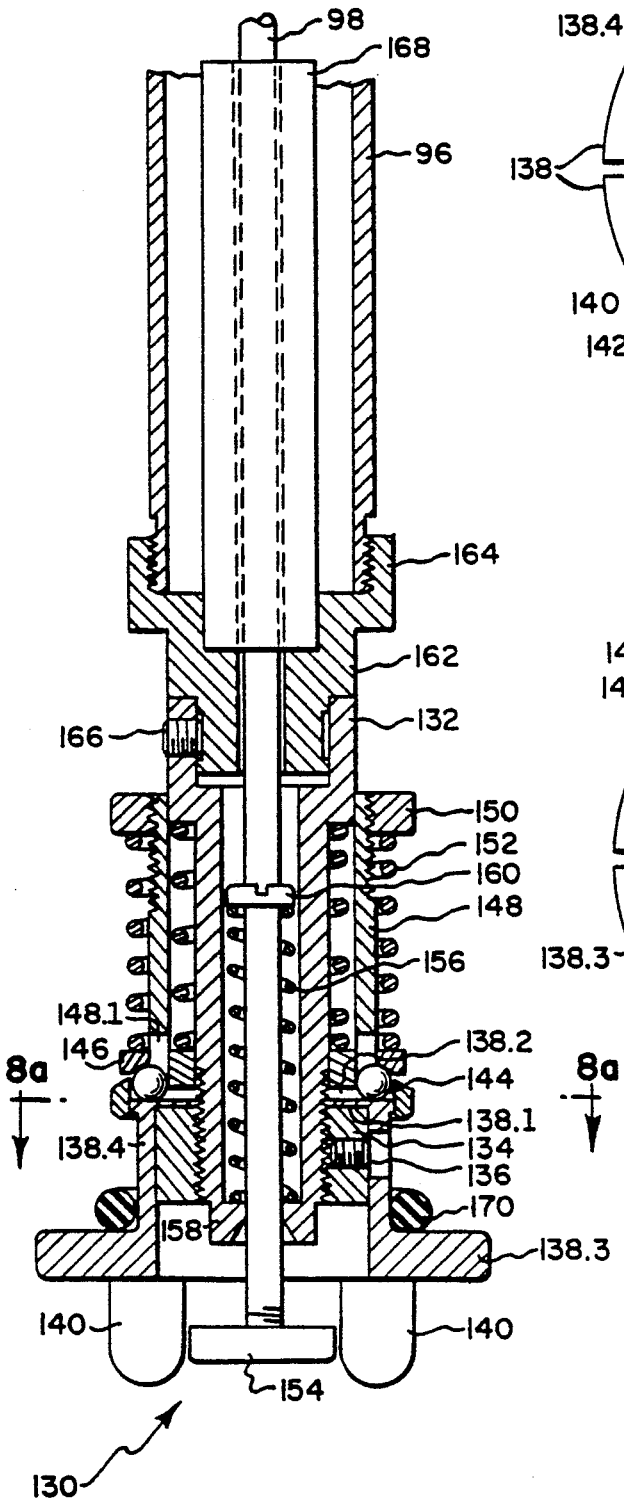
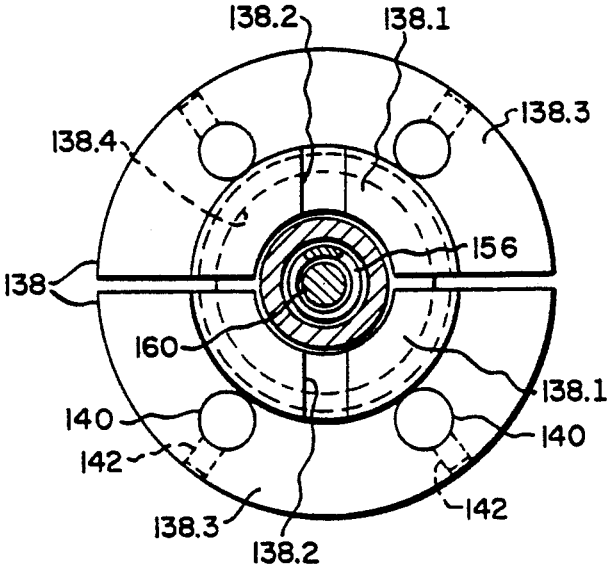
Fig. 8a.
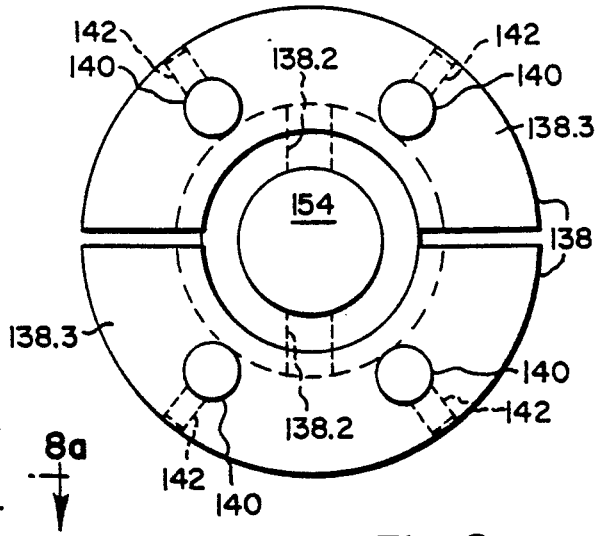
Fig. 8.

METHOD AND APPARATUS FOR APPLYING RECTANGULAR CLOSURES TO RECTANGULAR CONTAINERS

TECHNICAL FIELD

The present invention relates generally to the art of applying a closure to a container. The present invention has particular application where a stake-on cap having generally rectangular cross-sectional exterior surface is applied to a container whose body is also of the same general cross-section, the parts being delivered in random orientation and the cap being applied to the container in such a manner that it is in proper orientation with respect to the container when finally assembled.

BACKGROUND AND OBJECTS OF THE INVENTION

Prior art machines for applying closures to containers are well known in the art, and typical examples are U.S. Pat. Nos. 2,819,577, 3,054,240, and 4,089,153, the subject matter of which is incorporated herein by reference thereto. Various types of closures can be applied by these machines depending upon their particular configuration, the most common being roll-on caps, screw-on caps, and stake-on caps. In all of these designs the closure is applied in a turret, the closure being carried by a chuck which applies the closure as the containers are conveyed about the centerline of the turret, the chuck rotating about its centerline as the closure is applied.

The turret includes a rotatable portion and a fixed portion. A plurality of spaced apart chuck assemblies are carried by the rotatable portion of the turret, each chuck assembly being spaced away from the centerline of the rotatable portion of the turret, and each chuck assembly being rotable about its own centerline which is parallel to the centerline of the turret. Disposed below the chuck assemblies is a rotatable conveyor in the form of a star wheel or the like, containers being carried by this conveyor in axial alignment with the chuck assemblies. Disposed adjacent the turret assembly is a transfer table on which closures are placed for pick up by each chuck assembly. In these prior art machines the closures are generally of a circular cross-section and the orientation of the closure with respect to the container is not material. In one typical example, the closure will be picked up from the transfer table by a chuck assembly, for example the type as shown in U.S. Pat. No. 3,961,463, the subject matter of which is incorporated herein by reference thereto. After the chuck assembly and closure clear the transfer table, the chuck assembly will be lowered by a cam mechanism the chuck assembly also being rotated to screw on the closure onto the container. When the proper torque is achieved, the chuck assembly will spring open even though continued rotational movement is being applied to the chuck assembly. The rotatable portion of the turret continues to convey the container with the assembled closure until it is discharged, and the chuck assembly will be shifted back to a raised position where it can again pick up another closure to be applied to another container. The operation of these machines is well-known in the art and are sold to the trade as "CaPeM" capping machines by the Consolidated Packaging Machinery Company of Alden New York.

In the prior art machines with screw-on chuck assemblies, it has not been necessary to precisely position the chuck assembly with respect to the closure beforehand as the exterior surface of screw-on closures is generally circular. Therefore, the chuck assembly could be in any position of orientation with respect to the closure when the closure is initially engaged. This would also be the case with roll-on caps and with stake-on caps which are of a circular cross-section.

In prior art machinery where stake-on caps are applied to containers where the cap has a non-circular cross-section, the cap or closure has generally been presented to the assembly area in a specific orientation with respect to rotation, and it has also been the case that the container has also been provided in a specific orientation so that it is only necessary to pick up the cap, position it over the container, and bring the parts together to stake the closure onto the container. For example, the closures and containers may all be delivered to the assembly area of the container to that their fronts all face out.

A new container/closure assembly has recently been developed which will permit assembly of the closure onto the container by staking only when the closure is in one rotational position of orientation with respect to the container. However, this same container/closure design will permit rotation of the closure relative to the container in one direction of rotation until a stop on the closure engages a stop on the container to establish a correct position of orientation, at which time the closure can then be moved towards the container a distance sufficient to stake the closure onto the container.

OBJECTS AND SUMMARY OF THE INVENTION

It is an object of the present invention to provide a process and apparatus capable of assembling the newly developed closures onto their mating containers.

It is a further object of the present invention, to provide a novel chuck assembly which has a split-jaw assembly which can be rotated either 180° or 360° for proper assembly, so that the jaw assembly will always be in proper orientation with respect to a transfer table to satisfactorily pick-up closures which are to be assembled onto containers.

It is a further object of the present invention, to provide a machine which is capable of assembling stake-on closures having generally rectangular cross-sectional exterior portions onto containers having rectangular cross-sectional bodies, wherein the closures and containers may be delivered to the assembly area either with the front of the rectangular portion of the closure aligned with the front of the container body or with the back of the rectangular portion of the closure aligned with the front of the container body, which apparatus is also capable of applying screw-on closures, roll-on closures and stake-on caps which do not require specific orientation of the caps with respect to the container body.

The foregoing objects and other objects and advantages of the present invention are accomplished by providing a turret-type capping machine having a rotatable portion and a fixed portion. Vertically shiftable spindle assemblies are carried by the rotatable portion of the turret, each spindle assembly including Vertically shiftable spline shaft. A cam follower is connected to the spline shaft, the cam follower engaging a stationary cam on the fixed portion of the turret, the cam being capable of vertically shifting the spline shaft during rotation of the rotatable portion of the turret. A chuck assembly is carried by the lower end of the spindle assembly and is vertically shiftable with the spline shaft, the chuck assembly including a closure engagable portion capable of picking up a rectangular closure from a transfer table with the closure in either in aligned position where the front of the rectangular portion of the closure is aligned with the front of the container, or wherein the closure is in a 180° out-of-alignment position. A gear drive is provided for rotating the chuck assembly, the drive including a driven gear on the spline shaft, and a drive-gear segment which mates with the driven gear, the drive-gear segment being carried by a fixed portion of the turret. During rotation of the rotatable portion of the turret, the chuck assembly will be caused to be rotated 360° about its own axis. When it is desired to apply screw on closures, a chuck assembly of the type shown in U.S. Pat. No. 3,961,463 will be substituted for the chuck assembly shown in this patent application, and another driven gear on the spline shaft will be caused to be engaged with a continuous drive gear carried by the fixed portion of the turret, the alternate driven gear causing the spline shaft to be continuously rotated. As two gears are provided on the spline shaft, only one of which being operated at a time, a clutch mechanism is provided which will cause either one gear or the other to be coupled to the spline shaft.

The objects set forth above as well as additional objects and advantages of this invention will become more apparent after a consideration of the following detailed description taken in conjunction with the accompanying drawings in which a preferred form of this invention is illustrated.

BRIEF DESCRIPTION OF THE DRAWINGS

FIG. 1 is an exploded perspective view of the container and closure which is assembled by the method and apparatus of the present invention.

FIG. 1*a* is vertical section taken generally along a center vertical line of the assembled closure and container.

FIG. 2 is a perspective view of a capping machine in which the principles of the present invention may be incorporated.

FIG. 7 is a cross-sectional view of the chuck assembly of this invention.

FIG. 8 is a bottom view of the chuck assembly shown in FIG. 7.

FIG. 8*a* is a partial sectional view taken generally along the line 8*a*—8*a* in FIG. 8.

DETAILED DESCRIPTION

Figure 3:
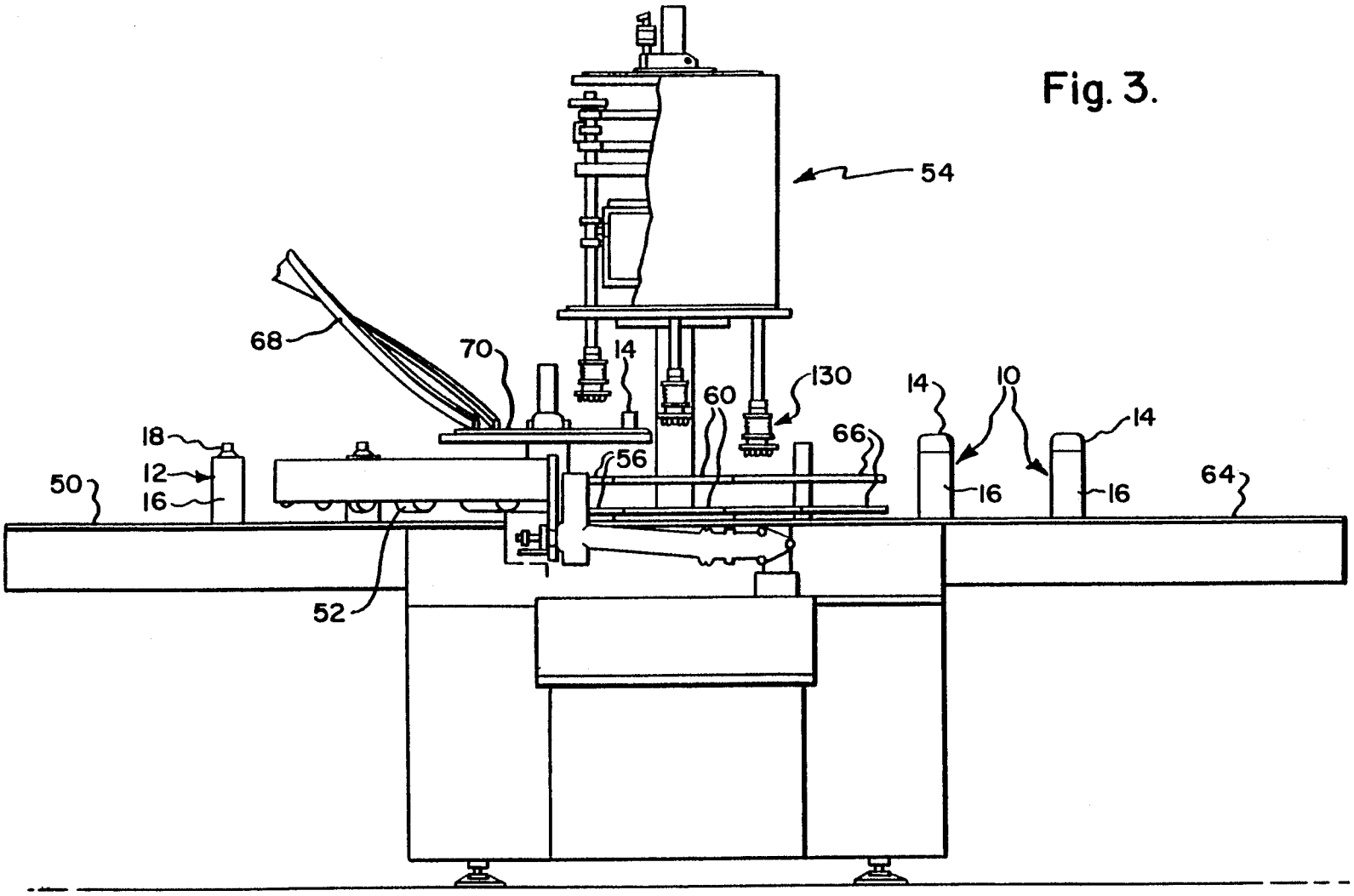
FIG. 3 is a front view of the capping machine shown in FIG. 2.

With reference first to FIG. 1, the container and closure which is adapted to be assembled by the method and apparatus of the present invention is indicated generally at 10. This assembly includes, as its principal components, a container indicated generally at 12 and a closure or cap indicated generally at 14. As can be seen from FIG. 1, the container 12 has a generally rectangular cross-sectional body portion 16 and a generally cylindrical neck portion 18. The neck portion is provided with an outwardly extending flange 20 and a cylindrically recessed portion 22 spaced below the flange, the outwardly extending flange 20 cooperating with an inwardly extending flange on the closure 14 for assembly. The container 12 further includes a shoulder portion 24 which is spaced slightly inwardly of the sides of the body portion 16, and a transition portion 26 which extends between the shoulder portion 24 and the recessed area 22 below the flange 20. Spaced above the flange 20 is an enlarged diameter cylindrical portion 28, there being a conical surface 30 between the cylindrical portion 28, and the neck portion 18. The neck portion 18 and the cylindrical portion 28, of the container are provided with a stop 32, there being a vertically extending groove 34 to one side of the stop surface 32*a*. The closure 14, which is to be staked onto the neck of the container 12, includes an exterior portion 35 having a generally rectangular cross-section. A flip-top lid 36 is carried by the closure, there being an underlying surface 38 (FIG. 1*a*) in the closure, which surface is provided with a small opening 40 which may be closed by a pin 42 carried by the flip-top lid 36. The small opening is in communication with a cylindrical or tubular portion 44 having a stop 46 on its internal surface. The stop 46 has a surface adapted to cooperate with the surface 32*a*. The stop 46 can be received within the vertically extending groove 34 when the parts are properly aligned, but when they are not aligned, the lower surface of the stop 46 will rest upon the conical surface 30. The tubular portion 44 is also provided within an internal lip or flange 48 which is adapted to snap over the outwardly extending flange 20 during assembly of the container and closure in a conventional manner as is well known in the container industry when a container receives a stake-on cap. It should be evident from an inspection of FIGS. 1 and 1*a* that the body portion has a front wall 16*f* and that the exterior portion of the cap also has a front wall 35*f*. These parts can only be assembled in alignment with each other when the stop 46 is in engagement with the stop surface 32*a*, and the stop 46 is received within the vertically extending groove 34.

Figure 4:
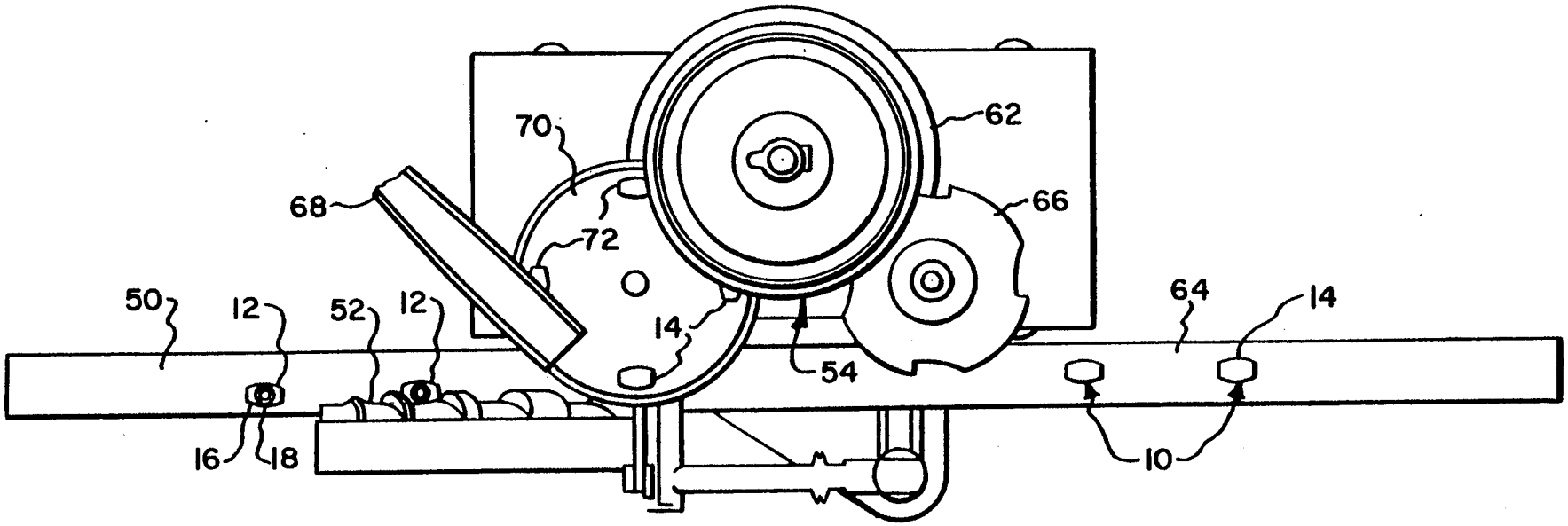
FIG. 4 is a plan view of the apparatus shown in FIG. 4.

Reference should now be made to FIGS. 2, 3 and 4. A container 12 which is to be assembled to a closure 14 is advanced into the assembly area by a feed conveyor 50. The feed conveyor 50 preferably includes a worm 52 which ensures that proper spacing between the containers 12 is maintained. The containers will be transferred from the feed conveyor to a turret indicated generally at 54 by a first in-feed transfer conveyor which consists of upper and lower spaced apart star conveyors 56 and suitable guard or filler plates 58 (not shown in FIGS. 3 and 4). Turret 54 is also provided with a star wheel conveyor 60 and suitable guides 62. The container and closure assemblies 10 which are assembled within the turret 54 are subsequently conveyed away from the turret 54 on a discharge conveyor 64, the assembled container 10 being transferred from the turret star wheel conveyor 60 to the discharge conveyor 64 by a discharge transfer conveyor which includes suitable star wheels 66.

The closure or cap 14 which is to be assembled onto a container 12 will be transferred to the assembly apparatus 54 from an orienting mechanism (not shown)

which ensures that the top of the closure is in an upper position, the closure being transferred down a chute 68 to a transfer table 70 which is provided with suitable spaced apart buttons 72. Each button is adapted to receive a single closure or cap and to transfer it from the lower end of the chute 68 to the turret 54 where it will be picked up by a chuck assembly for subsequent assembly onto the container. In the design of the present apparatus each button 72 has a generally rectangular cross-sectional configuration which is adapted to conform to the cross-sectional area of the interior of the exterior portion 35 of the cap. Thus, when each cap is associated with its button 72, it will be in one of two positions of orientation. More specifically, with reference to the transfer table 70, its front surface 35*f* may be facing out away from the center of the table or it may be facing in. It should also be noted at this point that the containers on conveyor 50 may be oriented in one of two manners, thus the front of each container 12 may be facing the front of the machine or the front of each container may be facing the rear. In view of the random orientation of the closure with respect to the container, it is necessary that proper orientation be achieved during assembly.

While the apparatus of the present invention has been designed specifically for applying closures to containers of the type shown in FIG. 1, it may also be used for applying other forms of closures to other types of containers. To this end, screw on caps may be supplied to a transfer table 70*a* having round buttons 72*a*. This feature will be brought out in greater detail below.

Figure 5:
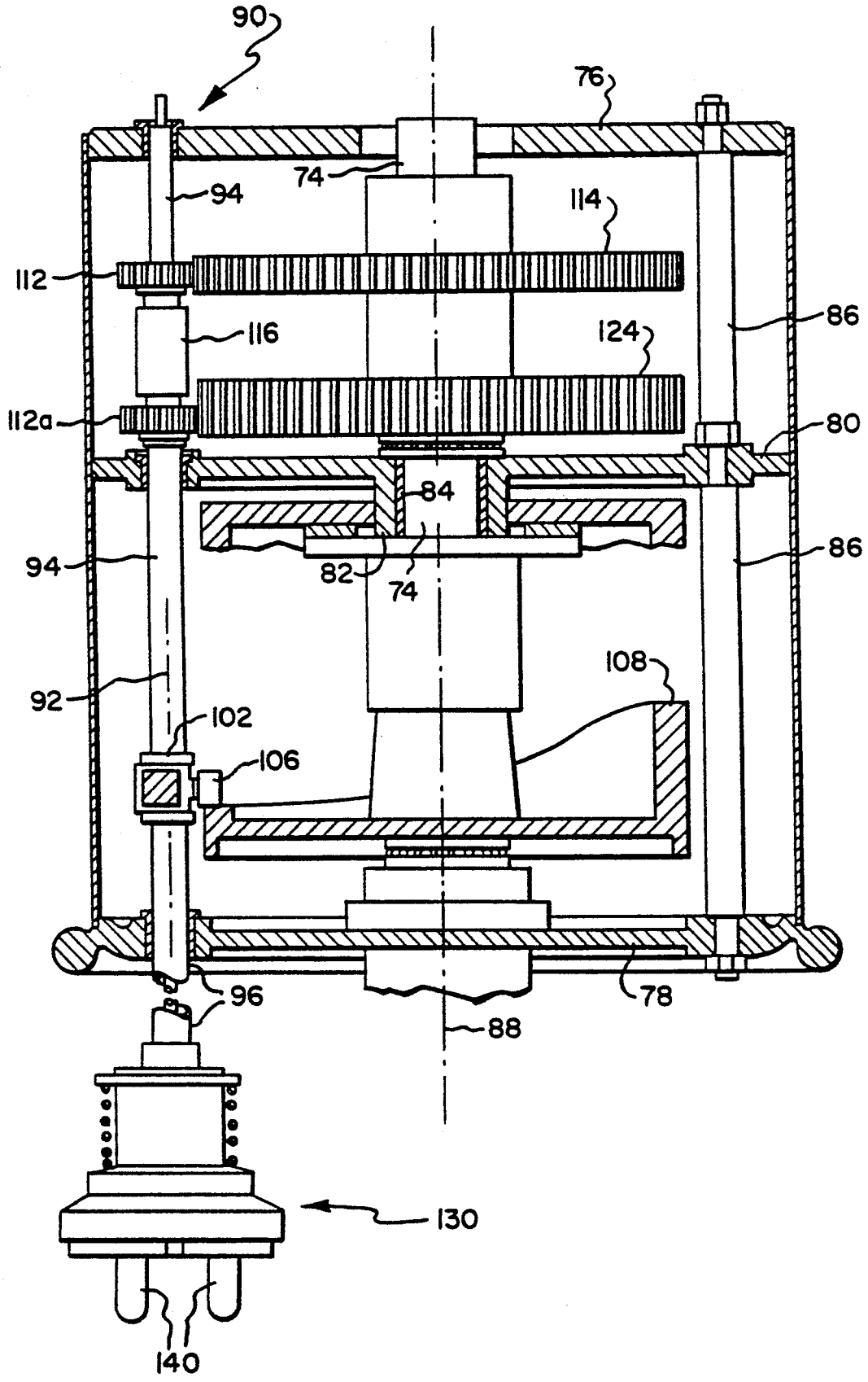
FIG. 5 is a cross-sectional view of the turret shown in FIG. 3, parts being eliminated for clarity.

With reference now to FIG. 5, the turret 54 includes a rotatable portion and a fixed portion. Thus, the turret has a central non-rotatable shaft 74 which extends from the bottom of the turret up to the top. Upper, lower and intermediate rotatable plates 76, 78, 80, respectively, are suitably rotatably mounted upon the central shaft 74. Thus, for example, the intermediate plate 80 may be provided with a hub 82 having a suitable bearing 84 between the hub and the shaft. In addition, suitable thrust bearings may be provided. The plates 76, 78 and 80 are caused to be rotatable together by suitable tie rods 86, and in the present apparatus three tie rod assemblies 86 are provided, the tie rod assemblies being spaced apart 120° from each other from the centerline 88. Because the various plates are tied together by the tie rods 86, it should be obvious that rotation to any one rotatable plate 76, 78 or 80 will cause the other plates to rotate with it, along with any apparatus mounted on the plates. The plates 76, 78, and 80 may be rotated in any conventional manner not material to the present invention.

Figure 6:
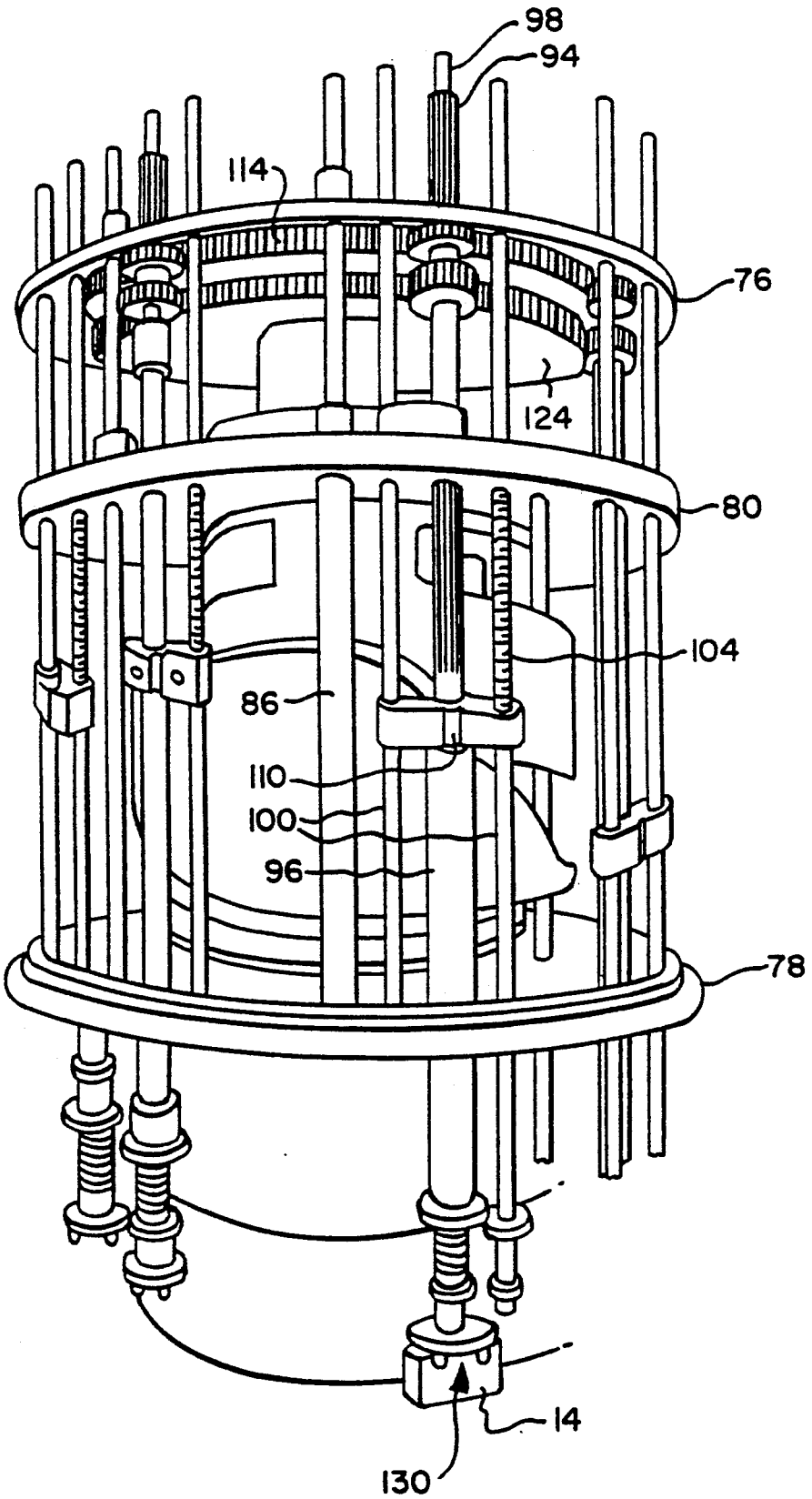
FIG. 6 is a partial side view of the turret shown in FIG. 5.
Figure 9:
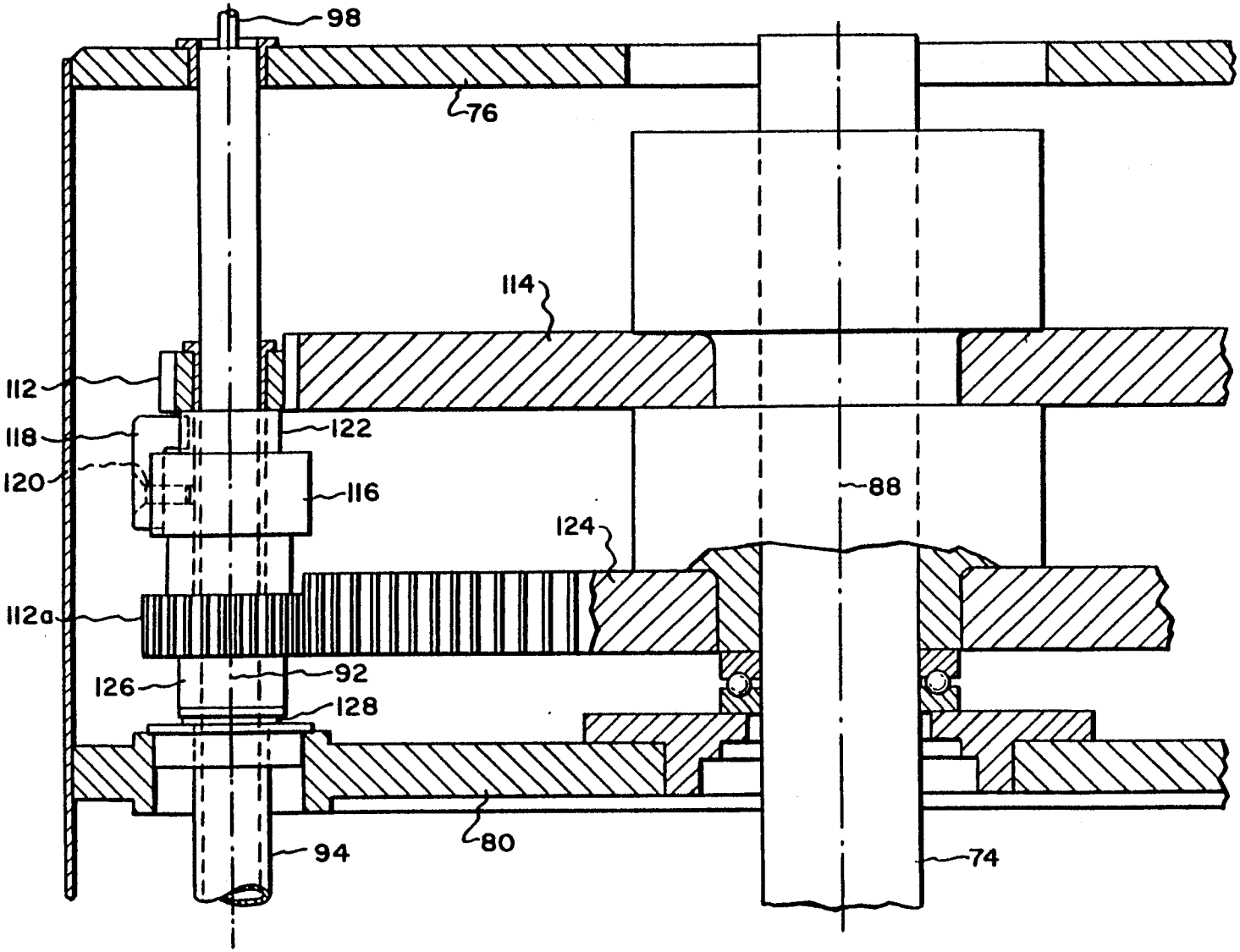
FIG. 9 is an enlarged detailed view of a portion of the gearing shown in FIG. 5.
Figure 10:
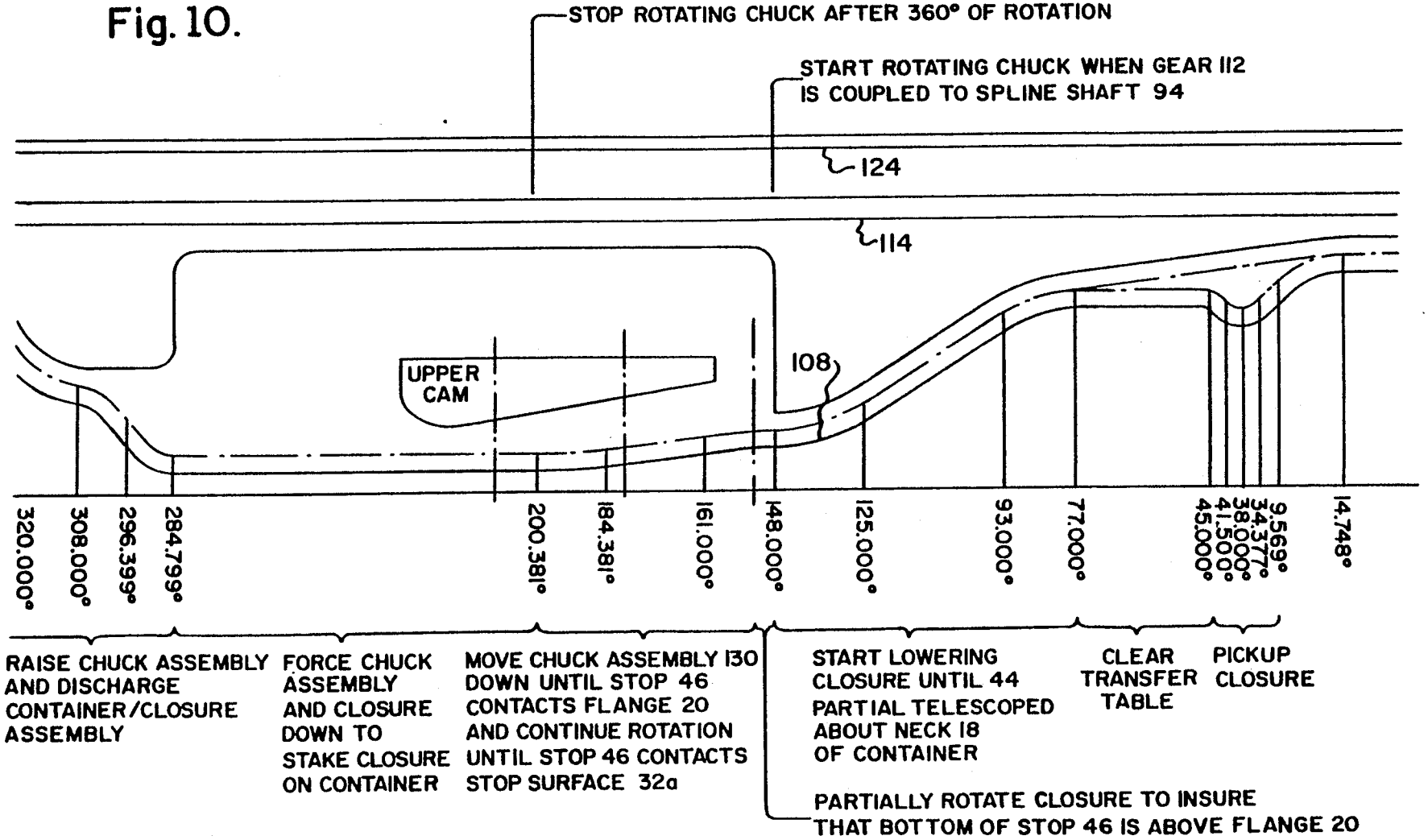
FIG. 10 is a developed view of the cam shown in FIGS. 3, 5 and 6, as well as the drive gears for rotatably driving the chuck assembly.

A plurality of vertically shiftable spindle assemblies indicated generally at 90, are carried by the plates 76, 78, 80. The turret may be provided with varying numbers of spindle assemblies. For example, six spindle assemblies may be utilized, in which case they will all be spaced 60° apart, the centerline 92 of each spindle assembly being spaced an equal distance away from the centerline 88 of the turret and also being parallel thereto. As can best be seen from FIGS. 6, 7 and 9, each spindle assembly includes a vertically shiftable spline shaft 94, which shaft extends through the upper plate 76 and the intermediate plate 80, a tubular extension 96 which is coupled to the spline shaft for movement therewith, and a stripper push rod 98. The lower end of the spline shaft 94 is suitably connected to the upper end of the tubular extension 96 in a manner not material to the present invention.

Spaced to either side of each of the spindle assemblies are guide rods 100. A cam follower holder 102 is slidably supported by the guide rods 100 for vertical movement between the lower and intermediate plates 78 and 80. A light spring 104 may be utilized to bias the cam follower holder in a downward direction to ensure that a cam follower 106 carried by the holder 104 is biased into engagement with a cam 108 carried by the fixed portion 74 of the turret. It can be seen from FIGS. 6 and 8 that as the rotatable portion 76, 78 and 80 of the turret are rotated with respect to the fixed portion, which includes the cam 108, vertical movement will be imparted to the vertically shiftable spindle assemblies 90. As it is desirable that each spindle assembly can rotate with respect to the cam follower holder, a groove 110 (FIG. 6) is formed in the upper end of the tubular extension 96, a portion of the cam follower holder 102 being received within this groove in such a manner that vertical movement of the cam follower holder will cause corresponding movement of the spline shaft 94 and tubular extension 96 but which will permit rotation of these parts about the centerline 92.

In order to impart rotation to each of the spindle assemblies, a driven gear 112 is coupled to each spline shaft 94, the gear 112 in turn meshing with gear teeth carried by a drive gear on the fixed portion of the turret 54. In accordance with one feature of this invention the spindle assembly 90 may be either continuously rotated as the turret assembly is rotated, or the spindle assembly may have imparted to it only 360° of rotation as measured about a line passing through the centerlines 88 and 92. This 360° of rotation will be imparted to the spindle assembly during partial rotation of the plates 76 through 80, for example 55° of rotation of the rotatable portion of the turret assembly. Thus, when applying the closure shown in FIG. 1, only 360° rotation is desired. To this end, a drive-gear segment 114 is fixedly secured to shaft 74. The drive gear 112 will only cause rotation of the spline shaft when the gear segment is being engaged by the teeth in gear 112. In order to provide for continuous rotation in an alternate design, it should be observed that the driven gear 112 is freely rotatable about the spline shaft 96 but may be coupled thereto by a clutch mechanism which includes a hub 116 (FIG. 9) which is provided with internal splines for sliding movement on the spline shaft 94, the hub further being provided with a key 118 which is movable between one of two positions. The key, when secured in one of its two positions by fastener 120 will cause the hub to be locked to a key extension of the driven gear 112 or 112*a*. Thus, it should be apparent from the above that as gear 112 is rotated it will cause corresponding rotation of key 118 about the axis 92, also causing rotation of the hub 116 and spline shaft. However, it should also be apparent that as the cam follower 106 engages cam 108 that the spline shaft can be moved upwardly and downwardly without causing corresponding movement of the driven gear 112 with respect to the gear 114. This is in part accomplished by the provision of suitable spacers and thrust bearings (not shown in FIG. 5) which trap the gear 112 in its desired position so that it lies in the same plane as gear segment 114.

Should it be desirable to continuously rotate the spline shaft 94, the hub 116 is secured to an alternate gear 112*a* which is in mesh with a drive gear 124 having teeth for 360°, this gear 124 also being secured for non-rotatable movement with respect to the central shaft 74. It can be seen from FIG. 9 that a spacer 126 is disposed below the driven gear 112*a*, the spacer 126 in turn resting upon thrust bearing 128 carried by the rotatable plate 80.

A chuck assembly 130 is carried by the lower end of each of the spindle assemblies 90. The centerline of each chuck assembly will be concentric with the centerline of a container 12 during assembly of the closure 14 onto the container. Each chuck assembly includes a chuck body 132 which is provided with a radially outwardly extending hub 134 at its lower end. The hub 134 may be a separate part as shown, in which case it is suitably screwed on to the lower end of the chuck body and secured in place by a setscrew 136. The chuck assembly further includes a closure engagable portion capable of picking up a closure 14 with the closure either in an aligned position where the front of the rectangular portion 35*f* is aligned with the front of the container 16*f* or wherein the closure is in a 180° out-of-alignment position. The closure engagement portion includes a split-jaw assembly consisting of two spaced apart jaws 138, each jaw having an upper inwardly extending flange 138.1 having a groove 138.2 provided therein, the lower surface of the flange normally resting in flush engagement with the top surface of the hub 134. Each jaw 138 further includes a lower radially outwardly extending portion 138.3 and an intermediate tubular portion 138.4 in the form of a portion of a cylinder of a slightly less than 180°. Mounted on the lower surface of the jaws are engagement pins 140 which are held in place by set screws 142. Spring-biased means are provided to bias the split-jaw assembly towards a closed position but which will permit the split-jaw assembly to be spread when engaging a closure, the spring-biased means maintaining engagement of the split-jaw assembly with the closure during the assembly. The spring-biased means further includes detent means for maintaining the split-jaw assembly in one of two rotational positions relative to the chuck body, the two rotational positions being spaced 180° apart, the detent means being releasable when resistance to rotational movement is encountered. The spring-biased means and the detent means includes two spaced apart balls 144, each of which balls is received within an associated groove 138.2 of the jaw 138, the jaw being biased in a downward direction by means of pressure imparted to the balls by a retaining washer 146. The balls are maintained in the groove 138.2 or the top of flange 138.1 as they are disposed within grooves 148.1 within the lower end of a spring housing 148, the upper end of the spring housing being provided with external threads. An adjusting nut 150 is threaded onto the upper end of the housing 148 the nut being used to vary the force of a coil spring 152 which extends between the adjusting nut 150 and the retaining washer 146, the coil spring also being disposed about an external intermediate surface of the spring housing 148. Mounted within the chuck assembly 130 is a stripper 154 which is vertically shiftable from a raised position (not shown) to a lower ejecting position shown in FIG. 7. The stripper will normally be maintained in its raised position by action of the stripper spring 156 which bears against a lower inwardly directly flanged portion 158 of the chuck body 132, the upper end of the spring 156 bearing against the head of a screw 160 which is screwed into the upper end of the stripper 154.

The upper end of the chuck body 132 is suitably secured to the lower end of the tubular extension 96 by an adapter 162 having a threaded tubular extension 164, the chuck in turn being secured to the adapter by a suitable setscrew 166. A short tubular extension 168 may be provided to provide suitable guidance for the pusher strip rod 98. In addition, it may be desirable to place an O-ring 170 about the split jaws 138 of the chuck assembly at a location immediately above the lower flange 132.

In operation the container 112 will be conveyed into the assembly area of the turret 54 and a closure 14 will be engaged between the engagement pins 140. This will happen when the chuck assembly 130 passes over the button 72 and the closure received thereon. Thus, the chuck assembly will be lowered while the parts are substantially axially aligned to cause the pins to engage the closure, the chuck assembly then being moved upwardly as the parts move out of the aligned relationship with respect to each other. The chuck assembly will now be lowered onto the container but, when applying the closures 14 shown in FIG. 1 there will be an initial engagement of the gear 112 with the gear segment 114 before the stop 46 engages the stop 32 to ensure that the parts are not in precise alignment with each other as the parts are moved together. This will cause the lower end of the stop 46 to initially ride upon the surface 30 during continued rotation of the chuck assembly about the axis 92. If the closure was initially out of engagement by 180°, there will be a further rotation of approximately 150° until the stop surface 32*a* is engaged by the stop 46. This will now cause the balls 44 to ride out of the groove 138.1 while there is a further 180° rotation of the spindle assembly. At the completion of this assembly there will be a downward movement imparted onto the chuck assembly to cause the closure to become staked onto the neck of the container. At this point it is only necessary to now raise the spindle assembly and a chuck assembly, to eject any closures that were not properly staked onto the container, and to discharge the assembled container.

In the event the screw on closures are to be applied, a chuck of the type shown in U.S. Pat. No. 3,961,463 will be substituted for the chuck shown in this application, and the hub 116 will be engaged with the alternate gear 112*a* to provide continuous rotation during assembly.

While a preferred form of the present invention has been described above and shown in the accompanying drawings, it should be obvious that other structures may be utilized to perform the principles of this invention. Therefore, it is to be understood that this disclosure is by way of example only and not by way of limitation.

What is claimed is:

1. A process for assembling stake-on closures each having a generally rectangular cross-sectional exterior portion onto containers each having a generally rectangular cross-sectional body and a cylindrical neck wherein the closures and containers may be delivered to the assembly area either with the front of the rectangular portion of the closure aligned with the front of the container body or with the back of the rectangular portion of the closure aligned with the front of the container body, the cylindrical neck being provided with an exterior stop and the closure having a cylindrical portion adapted to be staked-on the neck of the container, the interior surface of the cylindrical portion of the closure being provided with a stop which, when engaging the stop in the neck of the container will ensure that the front of the rectangular portion of the closure will be in alignment with the front of the container body, and wherein the container and closure are assembled together by a pressing motion; the process comprising the following steps:

providing a chuck assembly having a closure engagable portion, the chuck assembly having a centerline concentric with the centerline of the container during assembly of the closure onto the container;

picking up a closure with the closure engagable portion of the chuck assembly with the closure either in an aligned position where the front of the rectangular portion is aligned with the front of the container body or wherein the closure is in a 180° out-of-alignment position;

moving the chuck assembly and closure axially towards to the container until the closure and container are partially telescoped together;

rotating the chuck assembly 360°, the rotation of the closure and closure engagement portion of the chuck assembly being stopped when the container and closure are in proper rotational alignment as determined by the engagement of the closure stop with the container stop;

pressing the closure onto the container after the chuck assembly has rotated 360°; and moving the chuck assembly axially away from the container.

2. The process as set forth in claim 1 wherein the chuck assembly is rotated approximately 30° before the closure is onto the container an amount sufficient for the stops to engage one another.

3. Apparatus for assembling stake-on closures each having a generally rectangular cross-sectional exterior portion onto containers each having a generally rectangular cross-sectional body and a cylindrical neck wherein the closures and containers can be delivered to the assembly area with either the front of the rectangular portion of the closure aligned with the front of the container body or the back of the rectangular portion of the closure aligned with the front of the container body, the cylindrical neck of the container and mating portion of the closure both being provided with stops which, when mutually engaged, ensure that the front of the rectangular portion of the closure will be in alignment with the front of the container body, and wherein the container and closure are assembled together by a pressing motion; the apparatus comprising:

a chuck assembly having a closure engagable portion capable of picking up a closure with the closure either in an aligned position where the front of the rectangular portion is aligned with the front of the container or wherein the closure is in 180° out-of-alignment position, the chuck assembly having a centerline concentric with the centerline of the container during assembly of the closure onto the container;

means for moving the chuck assembly and closure axially towards to the container until the closure and container are initially partially telescoped together, then for pressing the closure onto the container after the chuck assembly as been rotated 360°, and then for subsequently moving the chuck assembly axially away from the container and closure after the assembly; and means for rotating the chuck 360°, the rotation of the closure and closure engagement portion of the chuck being stopped when the container and closure are in proper rotational alignment as determined by the engagement of the closure stop with the container stop.

4. The apparatus as set forth in claim 3 further characterized by the provision of a turret having a rotatable portion and a fixed portion, a vertically shiftable spindle assembly carried by the rotatable portion, the chuck assembly being carried by the lower end of the spindle assembly, the upper end of the spindle assembly being provided with a gear, and wherein a fixed portion of the turret carries a gear segment which will, during a portion of the rotation of the turret 360°, impart 360° of rotation to the chuck assembly during only a portion of the full 360° rotation of the turret.

5. The apparatus as set forth in claim 4 wherein the spindle assembly includes a cam follower which engages a cam carried by the fixed portion of the turret assembly, the cam imparting vertical shifting movement to the spindle assembly and chuck assembly.

6. A chuck assembly for assembling a closure having an exterior portion of a generally rectangular cross-section onto a container having a generally rectangular body wherein the closure may be initially in either proper rotational alignment with the container or may be out of proper rotational alignment with respect to the container by 180°; the chuck assembly comprising:

a chuck body;

a split-jaw assembly mounted on the chuck body for both radial movement between spread and closed positions and for rotational movement with respect to the chuck body;

spring-biased means operable to bias the split-jaw assembly towards a closed position but which will permit the split-jaw assembly to be spread when engaging a closure, the spring-biased means maintaining engagement of the split-jaw assembly with the closure during assembly; and detent means for maintaining the split-jaw assembly in one of two rotational positions relative to the chuck body, the two rotational positions being spaced 180° apart, the detent means being releasable when resistance to rotational movement is encountered.

7. The chuck assembly as set forth in claim 6 wherein the spring-biased means includes a coil spring, and means for adjusting the effective force applied by the coil spring.

8. The chuck assembly as set forth in claim 6 wherein the chuck body carries a radially outwardly extending hub at its lower end, wherein the split-jaw assembly includes two jaws, each jaw having an upper inwardly extending flange which is adapted to rest upon a hub portion of the chuck body, each flange being provided with a radially extending groove which can receive a ball detent; wherein the detent means include a pair of spaced apart balls which are received within radially outer portions of the grooves on the two spaced apart jaw members, and wherein the spring-biasing means bears against the balls to cause the inwardly extending flange to normally lie upon the top surface of the hub, but which will permit each of the jaws to pivot from its normal position along an inner surface of the flange, and which will also permit each of the jaws to rotate with respect to the hub as the ball is forced out of the ball groove during rotation of the jaw assembly with respect to the chuck body.

9. Apparatus for assembling closures onto containers, a first form of closures and containers both being provided with mating stops to ensure alignment when assembled so that the front of the closure will be in alignment with the front of the container, and a second form of closures and containers not being provided with stops whereby alignment is not ensured, the apparatus being provided with a first form of chuck assembly when alignment is to be attained, and a second form of chuck assembly when alignment is not to be attained, the first form of chuck only being rotated 360° during assembly; said apparatus comprising:

a turret having a rotatable portion and a fixed portion;

vertically shiftable spindle assemblies carried by the rotatable portion, each spindle assembly being rotatable with respect to the rotatable portion of the turret and capable of carrying at its lower end a chuck assembly engagable with a closure;

first and second spaced apart drive gears secured to the fixed portion of the turret;

first and second spaced apart driven gears rotatably carried by each spindle assembly in mesh with the first and second drive gears, respectively, the first drive gear rotating the first driven gear 360° during assembly of a first form of closures and containers; and coupling means operable to couple either the first or second driven gear to the spindle assembly for rotation therewith.

10. The apparatus as set forth in claim 9 wherein each of the spindle assemblies includes a spline shaft, and wherein the coupling means is a clutch mechanism including a splined hub mounted on the spline shaft for rotation therewith, a key on the hub, which key is movable between one of two positions, and key extensions on either of the driven gears which may be selectively engaged by the key.

* * * * *